US012055291B2

(12) United States Patent
Takeuchi

(10) Patent No.: US 12,055,291 B2
(45) Date of Patent: Aug. 6, 2024

(54) COMBUSTION APPARATUS

(71) Applicant: RINNAI CORPORATION, Aichi (JP)

(72) Inventor: Masaru Takeuchi, Aichi (JP)

(73) Assignee: RINNAI CORPORATION, Aichi (JP)

( * ) Notice: Subject to any disclaimer, the term of this patent is extended or adjusted under 35 U.S.C. 154(b) by 623 days.

(21) Appl. No.: 17/396,099

(22) Filed: Aug. 6, 2021

(65) Prior Publication Data

US 2022/0074591 A1 Mar. 10, 2022

(30) Foreign Application Priority Data

Sep. 10, 2020 (JP) ..... 2020-152179

(51) Int. Cl.
*F23N 1/02* (2006.01)
*F23N 5/20* (2006.01)

(52) U.S. Cl.
CPC ..... *F23N 1/022* (2013.01); *F23N 5/203* (2013.01); *F23N 2227/02* (2020.01); *F23N 2231/12* (2020.01)

(58) Field of Classification Search
None
See application file for complete search history.

(56) References Cited

U.S. PATENT DOCUMENTS 4,850,310 A * 7/1989 Wildgen ..... F23N 5/203 236/46 F
6,572,363 B1 * 6/2003 Virgil, Jr. ..... F23D 14/725 431/70
2008/0277488 A1 * 11/2008 Cockerill ..... F23N 5/203 236/51
2014/0188371 A1 * 7/2014 Miyaji ..... F02D 41/1454 701/103
2017/0219209 A1 * 8/2017 Suzuki ..... F23N 1/042

FOREIGN PATENT DOCUMENTS

JP 06-221547 A 8/1994

* cited by examiner

*Primary Examiner* — Edelmira Bosques
*Assistant Examiner* — Deepak A Deean
(74) *Attorney, Agent, or Firm* — Future IP LLC; Tomoko Nakajima

(57) ABSTRACT

A controller memorizes an accumulated combustion time by accumulating combustion time of a burner, and is set in a first lower-limit and a second lower-limit higher than the first lower-limit as a lower-limit lower than an initial value of an excess air ratio when reducing an excess air limit of a mixture gas of combustion air and a fuel gas, and the former is the lower-limit in case the accumulated combustion time is under a predetermined set time and the latter is the one in case the accumulated combustion time is the predetermined set time and over.

4 Claims, 3 Drawing Sheets

COMBUSTION APPARATUS

This application claims priority under 35 U.S.C. § 119 to Japanese Patent Application No. 2020-152179, filed Sep. 10, 2020, both of which are incorporated by reference.

TECHNICAL FIELD

The present invention relates to a combustion apparatus comprising: a burner disposed in a combustion chamber and for combusting a mixture gas of combustion air and a fuel gas; a fan for supplying the burner with combustion air; a gas supply passage for supplying the burner with the fuel gas; a proportional valve installed in the gas supply passage; an igniter for igniting the burner; an ignition detector for detecting the ignition at the burner; and a controller for controlling the fan, the proportional valve, and the igniter, respectively.

BACKGROUND ART

As this kind of combustion apparatus so far there is known a combustion apparatus in which the controller has set in advance an initial value of such an excess air ratio of the mixture gas as is suitable for the ignition at the burner. The controller is arranged as follows, i.e., when combustion of the mixture gas at the burner has been instructed, the controller adjusts an air volume of the combustion air and a gas volume of the fuel gas for making excess air ratio of the mixture gas to the initial value. In case the burner fails to ignite despite an ignition operation on the igniter, while stepwise reducing the excess air ratio of the mixture gas from the initial value, a re-ignition operation is repeated by the igniter (see e.g., patent document 1).

For example, in case the combustion apparatus is newly installed or on a similar condition, in a state in which air remains inside the gas supply passage and therefore the inside of the gas supply passage has not been sufficiently replaced by the fuel gas, the actual excess air ratio of the mixture gas supplied to the burner is higher than the initial value. Therefore, even though the igniter is caused to be performed by the ignition operation, there will occur a disadvantage in that no ignition takes place at the burner. In order to cope with this kind of disadvantage, the combustion apparatus described in the patent document 1 can cope with the matter, the controller stepwise reduces the excess air ratio of the mixture gas from the initial value, and causes the igniter to repeat the re-ignition operation.

PRIOR ART DOCUMENT

Patent Document

Patent Document 1: JP-A-1994-221547

SUMMARY

Problems that the Invention is to Solve

However, even though the excess air ratio of the mixture gas actually supplied to the burner is an initial value, there is a case in which the burner remains in ignition error due, for example, to an accidental factor such as sparking failure and the like at an ignition electrode. In such a case, the controller of the combustion apparatus as described in patent document 1 may misjudge that the excess air ratio of the mixture gas at that time was the initial value and over, and consequently reduces the excess air ratio. As a result, the excess air ratio of the mixture gas actually supplied to the burner will become excessively low. In this manner, if the igniter is caused to perform the re-ignition operation on the mixture gas with excessively low excess air ratio and to ignite the burner, there is a possibility that disadvantages may occur such as explosive ignition, poor combustion giving rise to generation of carbon monoxide gas, and the like.

In view of the above-mentioned matters, this invention has a problem of providing a combustion apparatus which appropriately adjusts the excess air ratio of the mixture gas actually supplied to the burner for easily accomplish the ignition at the burner and, at the re-ignition of the igniter, suppresses the occurrence of malfunctions such as explosive ignition, poor combustion and the like.

Means for Solving the Problems

In order to solve the above problems, a first aspect of this invention provides a combustion apparatus comprising: a burner disposed in a combustion chamber and for combusting a mixture gas of combustion air and a fuel gas; a fan for supplying the burner with combustion air; a gas supply passage for supplying the burner with the fuel gas; a proportional valve installed in the gas supply passage; an igniter for igniting the burner; an ignition detector for detecting ignition at the burner; and a controller for controlling the fan, the proportional valve, and the igniter, respectively. The controller has set in advance an initial value of such an excess air ratio of the mixture gas as is suitable for the ignition at the burner. The controller adjusts an air volume of the combustion air and a gas volume of the fuel gas for making the excess air ratio of the mixture gas an initial value upon receipt of instruction of combustion at the burner, stepwise reduces the excess air ratio of the mixture gas from the initial value in case the burner fails to ignite despite an ignition operation of the igniter, and causes the igniter to repeatedly perform a re-ignition operation.

In the above-mentioned combustion apparatus the controller memorizes an accumulated combustion time by accumulating combustion time of the burner, and wherein the controller is set as a lower-limit value of the excess air ratio of the mixture gas for reducing from the initial value in the re-ignition operation of the igniter, a first lower-limit value in case the accumulated combustion time is under a predetermined set time, and a second lower-limit value which is higher than the first lower-limit value in case the accumulated combustion time is the predetermined set time and over.

According to the first aspect of this invention, in case the accumulated combustion time is under the predetermined set time, the mixture gas actually higher in excess air ratio than the initial value is supplied to the burner due to the remaining air inside the gas supply passage and the burner is estimated not to ignite, the controller stepwise reduces the excess air ratio to succeed ratio of the mixture gas based on the first lower-limit value from the initial value. Then, the re-ignition operation of the igniter is repeated. Similar to the conventional one, it becomes easier to succeed in the burner. In addition, in case the accumulated combustion time is the predetermined set time and over and an inside of the gas supply passage is estimated to have been replaced by the mixture gas, the controller stepwise reduces the excess air ratio of the mixture gas, based on the second lower-limit value from the initial value, thereby causing the re-ignition operation of the igniter to repeatedly operate. Therefore, the excess air ratio of the mixture gas can be prevented from unnecessarily reducing. In the re-ignition operation of the igniter problems such as explosive ignition, poor combustion causing generation of carbon monoxide gas, and the like in the re-ignition operation of the igniter can be suppressed.

By the way, the excess air ratio of the mixture gas is largely classified as two kinds, i.e., the initial value suitable for the ignition at the burner, and a value reduced in the re-ignition operation of the igniter. The former is a value set in advance in the controller, and is an estimated value which is estimated under consideration of a kind of the fuel gas, the combustion characteristics of the burner, air supply capacity of the fan, and the like. On the other hand, as the latter, an actually measured value may also be employed, or an estimated value may be employed in a manner similar to that in the initial value. It is known that the combustion air supplied to the burner has a correlation with the rotational speed of the fan, and also that the gas volume of the combustion gas has a correlation with the current charged to the proportional valve (hereinafter called "proportional-valve current"). Therefore, the such excess air ratio of the mixture gas as is reduced in the re-ignition operation of the igniter need not necessarily be an actually measured value, but can be estimated from the rotational speed of the fan and the proportional-valve current value. Therefore, the above-mentioned two kinds of the excess air ratios of the mixture gas can be replaced by the estimated values.

The second aspect of this invention provides the combustion apparatus in which the controller preferably performs the stepwise reduction of the excess air ratio of the mixture gas from the initial value in the re-ignition operation of the igniter by stepwise increasing the gas volume of the fuel gas supplied to the burner. Here, it is to be pointed out that the stepwise reduction of the excess air ratio of the mixture gas from the initial value in the re-ignition operation of the igniter can also be performed by decreasing of the air volume of the combustion air. As to concrete manners for increasing the gas volume of the fuel gas or decreasing the air volume of the combustion air, the following five patterns can be estimated, although there will be a possibility to bring about relatively easiness or difficulty in the control of the controller.

Pattern 1: While keeping the air volume of the combustion air constant at a predetermined volume, the gas volume of the fuel gas is increased.

Pattern 2: The gas volume of the fuel gas is increased together with increase of the air volume of the combustion air, as a result, the excess air ratio of the mixture gas is reduced.

Pattern 3: The gas volume of the fuel gas is increased together with decrease of the air volume of the combustion air.

Pattern 4: While keeping the gas volume of the fuel gas constant at a predetermined volume, the air volume of the combustion air is decreased.

Pattern 5: The air volume of the combustion air is reduced together with reduction of the gas volume of the fuel gas, as a result, the excess air ratio of the mixture gas is decreased.

In the re-ignition operation of the igniter, the stepwise reduction of the excess air ratio from the initial value, which is accomplished by the stepwise increase of the gas value of the fuel gas supplied to the burner, corresponds to the pattern 1, pattern 2 and pattern 3. By so doing, as compared with the above-mentioned pattern 4 and pattern 5, the gas volume of the fuel gas to pass through the inside of the gas supply passage toward the burner increases. Therefore, the air remaining inside the gas supply passage can be replaced by the fuel gas more quickly. As a consequence, the ignition at the burner can be earlily accomplished.

The third aspect of this invention provides the combustion apparatus in which the controller preferably counts the number of repetitions of the re-ignition operations of the igniter, judges that an ignition error has occurred in case the ignition at the burner fails to take place even after the number of repetitions has reached the predetermined number of repetitions, cancels the instruction of the combustion, and warns an ignition error.

The controller memorizes the excess air ratio of the mixture gas in the such re-ignition operation of the igniter as was performed immediately before the judgment of the ignition error.

The controller adjusts the excess air ratio of the mixture gas in the ignition operation of the igniter to not more than the memorized excess air ratio after the judgment of the ignition error, cancellation of the instruction of the combustion and warning of the ignition error, when the warning of the ignition error has been cancelled and the combustion is once again re-instructed, in case elapsed time from the judgment of ignition error or from the cancellation of the warning of the ignition error to the re-instruction of combustion is within a predetermined elapsed time. In case such the elapsed time from the judgment of ignition error or from the cancellation the warning of ignition error to the re-instruction of combustion is within the predetermined elapsed time, the first instruction of combustion and the re-instruction of the combustion are estimated to be made in succession. Therefore, the excess air ratio of the mixture gas at the time of the re-instruction of the combustion can be reduced to the one which is lower than the initial value at the time of the initial instruction. Such being the case, the stepwise reduction of the excess air ratio of the mixture gas toward the first lower-limit value or the second lower-limit value can be accelerated, whereby the ignition at the burner can be more easily accomplished. Further, in case the excess air ratio of the mixture gas at the time of the re-instruction of the combustion is reduced to the one which is lower than that of the mixture gas, which has been memorized at the time of the re-ignition operation of the igniter, immediately before the judgment of ignition error, the reduction in the excess air ratio of the mixture gas can be more promoted. It is thus more advantageous due to the ignition at the burner. For example, depending on the such predetermined number of times as set the number of repetitions of the re-ignition operations of the igniter, the number of repetitions of the re-ignition operations of the igniter. The number of repetitions of the re-ignition of the igniter will not reach the first lower-limit or the second lower-limit but reaches predetermined number of the repetitions of the re-ignition operations of the igniter. There is a case in which the controller will make a discrimination of the ignition error. In such a case, the adjustment of the excess air ratio of the mixture gas in the re-instruction of the combustion will be advantageous to an early ignition at the burner.

The fourth aspect of this invention provides the combustion apparatus further comprising an accumulated combustion time eraser for erasing the accumulated combustion time that the controller has memorized. After a lapse of predetermined accumulated combustion time from the installation of the combustion apparatus accompanied by re-filling of a gas tank, renewal of the gas supply passage, and the like, there is a case in which the excess air ratio of the mixture gas actually supplied to the burner exceeds the initial value due to the air again remaining inside the gas supply passage, the accumulated combustion time memorized by the controller can be erased by the accumulated combustion time eraser. Therefore, the lower-limit value of the excess air ratio of the mixture gas to be stepwise reduced from the initial value in the re-ignition operation the igniter is renewed from the second lower-limit value once again to the first lower-limit value. Accordingly, as is the same case of a new installation of the combustion apparatus, and the like, the ignition at the burner may be more easily accomplished.

EMBODIMENTS FOR CARRYING OUT THE INVENTION

Figure 1:
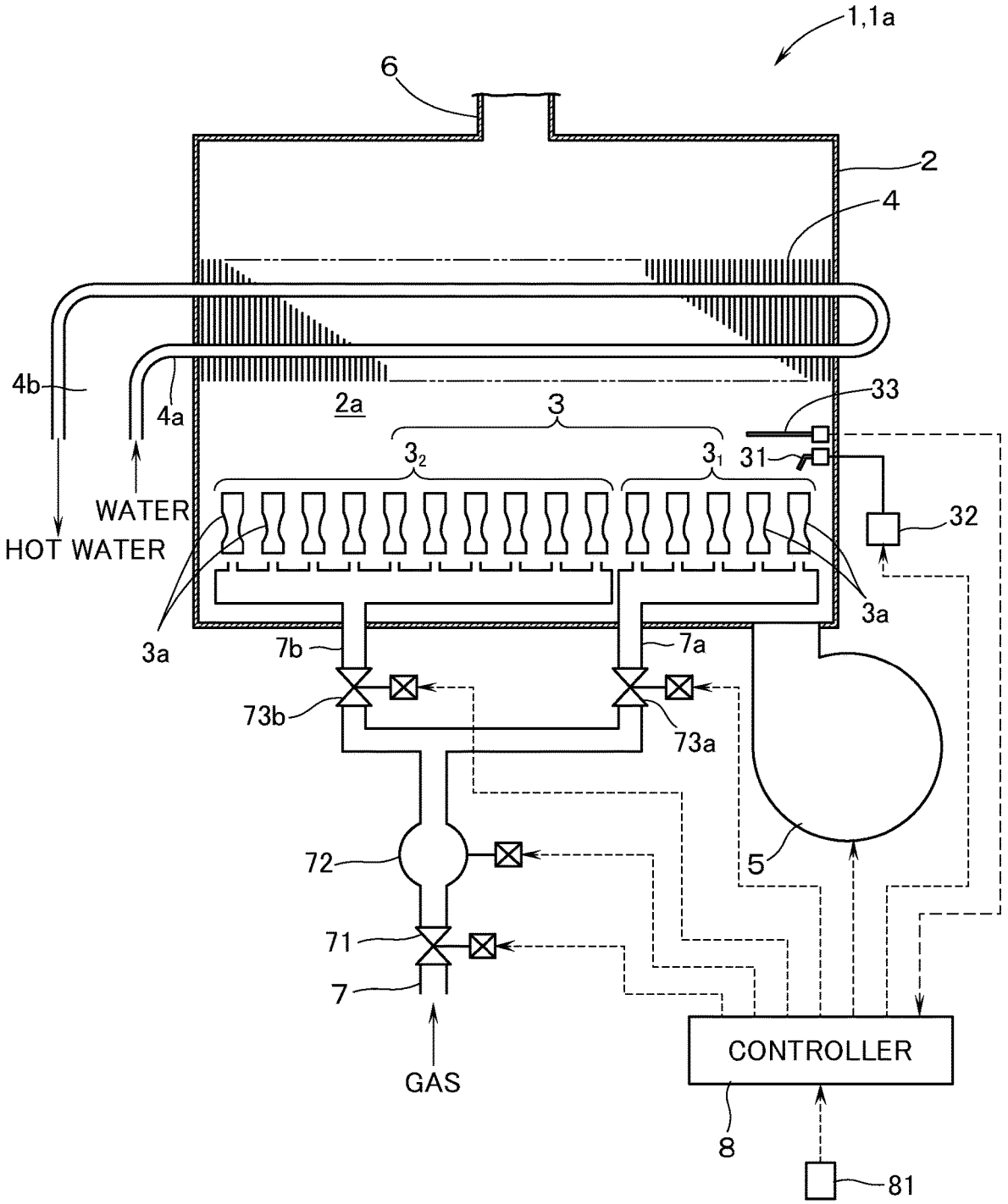
FIG. 1 is a schematic view showing a heat-source apparatus for hot water supply according to an embodiment of a combustion apparatus of this invention.

With reference to FIG. 1, a description will be made of a general outline of a heat-source apparatus 1*a* which is an embodiment of a combustion apparatus 1 of this invention. The heat-source apparatus 1*a* for hot water supply is provided with a combustion chamber 2*a* enclosed by a combustion box 2. At a lower part of the combustion chamber 2*a* there are disposed burners 3. The burner 3 is made up of a first portion $\mathbf{3}_1$ arranged, in parallel with one another, by five unit burners 3*a*, and a second portion 32 arranged, in parallel with one another, ten unit burners 3*a*. Further, the combustion chamber 2*a* is provided with an ignition electrode 31 facing the first portion 31 of the burner 3. There is also provided an igniter 32 which is a high-voltage application source for the ignition electrode 31. The igniter 32 performs an ignition operation through energization so that, by causing sparking of the igniter electrode 31, the first portion $\mathbf{3}_1$ is ignited. Further, the combustion chamber 2*a* is provided with a flame rod 33 as an ignition detector for detecting the ignition at the first portion $\mathbf{3}_1$ of the burner 3.

At an upper part of the combustion chamber 2*a* there is disposed a heat exchanger 4, as an object to be heated, for hot water supply. The lower surface of the combustion chamber 2 has connected thereto a fan 5 for supplying the burner 3 with combustion air. The combustion air supplied by the fan 5 is made up of primary air directly supplied to the unit burners 3*a*, and second air supplied to the neighborhood of burner ports of the unit burners 3*a* through the lower part of the combustion chamber 2*a*. By the combustion gas from the burner 3, water from a water supply pipe 4*a* on an upstream side of the heat exchanger 4 is heated and hot water heated to a predetermined set temperature is discharged out of a hot water supply pipe 4*b* on a downstream side of the heat exchanger 4. The combustion gas that has passed through the heat exchanger 4 is exhausted to an outside of the combustion chamber 2*a* through an exhaust passage 6 which is connected to an upper surface of the combustion chamber 2.

A gas supply passage 7 for supplying the burners 3 with a fuel gas has interposed therein a main valve 71 which is made up of an electromagnetic on-off valve, and a proportional valve 72 on a downstream side of the main valve 71. Such a portion of the gas supply passage 7 as is on the downstream side of the proportional valve 72 is divided into two, i.e., a first branched passage 7*a* which is communicated with the first portion 31 of the burner 3, and a second branched passage 7*b* which is communicated with the second portion 32 of the burner 3. The first branched passage 7*a* and the second branched passage 7*b* have respectively interposed therein a first capacity change-over valve 73*a* and a second capacity change-over valve 73*b*, each being made up of an electromagnetic on-off valve. The burner 3 is supplied, by opening and closing the first capacity change-over valve 73*a* and the second capacity change-over valve 73*b*, with the fuel gas to either the first portion 31, or to both the first portion 31 and the second portion 32. It is thus so arranged that the combustion capacity of the burner 3 can be switched in two steps. By the way, in the ignition operation of the igniter 32, the burner 3 is supplied with a mixture gas of the fuel gas and the combustion air.

In addition, the heat-source apparatus 1*a* for hot water supply has a controller 8 for controlling the fan 5, the main valve 71, the proportional valve 72, the first capacity change-over valve 73*a*, the second capacity change-over valve 73*b*, and the igniter 32. The controller 8 is constituted by a microcomputer which is provided with CPUs, ROMs, RAMS, A/D converters, interfaces and the like. The flame rod 33 is connected to the controller 8.

A description will now be made, with reference to FIG. 2, of a first embodiment of control performed by the controller 8 as shown in FIG. 1. For convenience' sake, it is explained that an "excess air ratio of the mixture gas" is a rate of divergence of an air volume of the combustion air that is actually supplied, to a theoretical volume of air volume of combustion air required for the combustion of the fuel gas at the burner 3 shown in FIG. 1. This excess air ratio of the mixture gas can be actually measured as explained above. But the air volume of the combustion air supplied to the burner 3 is known to have a correlation with the rotational speed of the fan 5. Further, the gas volume of the fuel gas supplied to the burner 3 is also known to have a correlation with the proportional-valve current charged to the proportional valve 72. Therefore, the excess air ratio of the mixture gas can be estimated by the rotational speed of the fan 5 and the proportional-valve current charged to the proportional valve 72. Such being the case, in this embodiment, the "excess air ratio of the mixture gas" that is stepwise reduced from the initial value in a re-ignition operation, to be described later, is not an actually measured value, but an estimated value. In addition, such the initial value of the excess air ratio of the mixture gas as is set in the controller 8 and is suitable for the ignition at the burner 3, is an estimated value of the excess air ratio suitable for the ignition at the burner 3, the initial value being estimated considering the kind of the fuel gas, combustion characteristics of the burner 3, air supply capacity of the fan 5, and the like. This estimated value corresponds to such an excess air ratio of the mixture gas as is required when the heat source apparatus 1*a* for hot water supply is steadily used and when the combustion is repeated.

In the control of the controller 8 as described below, by stepwise increasing the proportional-valve current while keeping the rotational speed of the fan 5 in the ignition operation constant, at a predetermined rotational one, the gas volume of the fuel gas is stepwise increased so that the air volume of the mixture gas is relatively reduced and the excess air ratio is reduced. Then, the controller 8 memorizes the proportional-valve current value corresponding to the gas volume of the fuel gas after the increase. As described above, the excess air ratio of the mixture gas is substituted by the proportional-valve current value.

Once the combustion at the burner 3 has been instructed, as described later, the controller 8 stops a timer, and discriminates whether the elapsed time Te from the time of judgment of the ignition error is within a predetermined elapsed time (e.g., 30-60 seconds) that is set in advance in the controller 8 (STEP 1). The instruction of combustion is implemented: by issuing a combustion permission (operation ON) from a remote controller connected to the controller 8 to the heat-source apparatus 1*a* for hot water supply and by opening a hot-water tap such as a faucet and the like which is disposed at an end of a hot water supply pipe 4*b*. In case the elapsed time Te is within the predetermined elapsed time, and in case the instruction of combustion corresponds to the one issued after several times of instructions, the controller 8 reads the proportional-valve current memorized in the control performed by the second-to-the last instruction of the combustion, which corresponds to the gas volume of the fuel gas, as described later in the such re-ignition operation of the igniter 32 as was performed immediately before the judgment of ignition error (STEP 2). On the other hand, in the case of an initial instruction of the combustion after the heat-source apparatus 1*a* for hot water supply has been installed, there exists no instruction of the combustion before the initial one, therefore in STEP 2, the controller 8 uses a proportional-valve current corresponding to an initial value of an excess air ratio of the mixture gas, which is set in advance in the controller 8 and is suitable for the ignition of the burner 3 in place of the above-mentioned proportional-valve current value.

Subsequently, the fan 5 is driven to supply the air into the combustion chamber 2*a* in order to perform pre-purging in which the mixture gas and the like remaining inside the combustion chamber 2*a* is exhausted outside through the exhaust passage 6 (STEP 3). Thereafter, the rotational speed of the fan 5 is kept constant at a predetermined rotational speed, the main valve 71 and the first capacity change-over valve 73*a* are energized to open. In addition, the proportional valve 72 is energized to open and the mixture gas of the combustion air and the fuel gas is supplied to the first portion 31 of the burner 3. In case of the initial ignition operation, the proportional-valve current value of the proportional valve 71 corresponds to the initial value of the excess air ratio of the mixture gas. On the other hand, in case of the re-ignition operation as described later, if the elapsed time Te is within the predetermined elapsed time, the proportional-valve current value of the proportional valve 71 at this time is the one corresponding to the gas volume of the increased fuel gas in the re-ignition operation performed immediately before the judgment of the ignition error. By the way, if the elapsed time Te has exceeded the predetermined elapsed time, the proportional-valve current value of the proportional valve 71 at this time is the one corresponding to the initial value of the excess air of the mixture gas. Thereafter, the igniter 32 is energized for performing the ignition operation and thereby a spark occurs at the ignition electrode 31 (STEP 4). Then, based on presence or absence of ignition detection by the flame rod 33, the controller 8 discriminates whether the ignition has taken place on the first portion 31 of the burner 3 (STEP 5). In case the ignition has taken place on the first portion 31 of the burner 3, the timer is started up to measure the combustion time. This measurement of the combustion time is performed at each time of the instruction of the combustion. The controller 8 also accumulates the measured combustion time and memorizes the accumulated combustion time Ta, and renews the accumulated one (STEP 6). Further, in case the ignition has taken place on the first portion 31 of the burner 3 by the re-ignition operation, the controller 8*n* erases the memorized proportional-valve current value which corresponds to the increased gas volume of the fuel gas in the re-ignition operation at the time immediately before the ignition (STEP 7). At the initial instruction of the combustion, the gas volume of the fuel gas is the one corresponding to the initial value of the excess air ratio of the mixture gas that was set in advance in the controller 8. Therefore, even though the STEP 7 is performed, the gas volume of the fuel gas will not change. Then, by opening the second capacity change-over valve 73*b* so as to cause carryover to take place to the second portion 32 of the burner 3, the combustion capacity is changed over.

Thereafter, the controller 8 discriminates whether stopping the combustion is instructed or not (STEP 8). If the instruction of stopping combustion has not been instructed, the steps from STEP 5 to STEP 8 are repeatedly performed. Once the stopping the combustion has been instructed, the timer is stopped and also, as described later, a counter is caused to count and memorize, and the renewed number of repetitions of the re-ignition operation is erased (the number of repetitions of the re-ignition operation) (STEP 9). At this time, the energizing of the igniter 32 is stopped and the opened first capacity change-over valve 73*a*, or the opened one of the first capacity change-over valve 73*a* and the second capacity change-over valve 73*b*, and the proportional valve 72 and the main valve 71 are closed and at the same time the fan 5 is stopped to thereby finish the combustion. Then, the heat-source apparatus 1*a* for hot water supply standbys until the re-instruction of the combustion. The instruction of stopping the combustion is issued at the same time as the issuance of the combustion stop (operation OFF) by the above-mentioned remote controller to the heat-source apparatus 1*a* for hot water supply or at the same time as the closure of the hot water tap and consequent water stop.

On the other hand, even though the igniter 32 is energized in STEP 4 so as to cause the ignition operation, thereby causing the ignition electrode 31 to spark, ignition does not take place at the first portion 31 of the burner 3 in STEP 5, the controller 8 once closes the first change-over valve 73*a*, the proportional valve 72 and the main valve 71 and stops the fan 5. In addition, the ignition operation of the igniter 32 is also stopped. Thereafter, the controller 8 discriminates whether the number of repetitions of the re-ignition operation that has been counted and memorized and renewed by the counter falls within the predetermined number of times that has been set in the controller (STEP 10). Here, the re-ignition operation is an operation for the igniter 32 to perform the re-ignition operation. In the re-ignition operation by the igniter 32, the controller 8 reopens the once closed main valve 71, the closed proportional valve 72 and the closed first change-over valve 73*a*, and the fan 5 is driven once again. In case the number of repetitions of the re-ignition operation by the igniter 32 is under the predetermined number of repetitions, the controller 8 discriminates whether the accumulated combustion time Ta that has been memorized and renewed in STEP 6 is under the set time that has been set in advance in the controller 8 (STEP 11). In case the ignition has not taken place in the first portion 31 of the burner 3 by the initial instruction of the combustion, since the combustion time is not measured. The accumulated combustion time Ta will be zero and the controller 8 discriminates that the accumulated combustion time Ta is under the set time.

STEP 11 relates to a discrimination in which, depending on whether the heat-source apparatus for hot water supply 1*a* is in a state of being still young in the installation or depending on whether the combustion by the burner 3 has been repeatedly performed, the lower-limit value for reducing the excess air ratio of the mixture gas from the initial value is differentiated so that the adjustment of the excess air ratio of the mixture gas is performed correctly. In case the combustion is instructed for the first time after the heat source apparatus 1*a* for hot water supply has installed, air remains inside the gas supply passage 7. Therefore, in the ignition operation in STEP 4, even though the excess air ratio of the mixture gas is supplied to the first portion 31 of the burner 3 by adjusting the excess air ratio of the mixture gas to the initial value, the excess air ratio of the mixture gas that is actually supplied to the first portion 31 of the burner 3 will become higher due to the remaining air inside the gas supply passage 7. Therefore, it is necessary to sufficiently reduce the excess air ratio in order to combust the mixture gas with the burners 3. In addition, in case the heat-source apparatus 1*a* is in a state in which the combustion at the burner 3 has been consecutively repeated a plurality of times, a gas inside supply passage 7 has been replaced with the fuel gas. Therefore, the reduction of the excess air ratio of the mixture gas supplied to the first portion 31 of the burner 3 must be suppressed in order not to occur such as explosive ignition at the burner 3, generation of carbon monoxide gas, and the like.

For that reason, in the controller 8, two lower-limit values of the excess air ratio in reducing the excess air ratio of the mixture gas and both of the two lower-limit values are lower than the initial value. In other words, one is the first lower-limit value A which corresponds to a state after relatively no time in which the heat-source apparatus 1*a* for hot water supply has been installed, and the other is the second lower-limit value B which corresponds to a state in which the combustion of the heat-source apparatus 1*a*, after installation, has been repeated a plurality of times. The second lower-limit value B is set at a higher value than the first lower-limit value A (A<B). But, the first lower-limit value A is also selected to be a value which is estimated to be free from the problems such as explosive ignition at the burners 3, generation of carbon monoxide gas, and the like. Then, when the accumulated combustion time Ta is discriminated in STEP 11 to be under the set time, the controller 8 selects the first lower-limit value A (STEP 12). Or else, in case the accumulated combustion time Ta is discriminated to be the set time and over, the second lower-limit value B is selected (STEP 13).

Reduction of the excess air ratio of the mixture gas from the initial value by the controller 8 is performed as described above. Namely, by increasing stepwise the proportional-valve current while keeping the rotational speed of the fan 5 constant at a predetermined rotational speed, the gas volume of the fuel gas is stepwise increased so that the air volume in the mixture gas is relatively decreased. In concrete, an increasing value of the proportional-valve current which corresponds to a reduction amount of the excess air ratio of the mixture gas per one time of the re-ignition operation is set in the controller 8 in STEP 4. The such reduction amount of the excess air ratio as above-mentioned is calculated by equally dividing reduction amount of the excess air ratio of the mixture gas from the initial value to the first lower-limit value A or to the second lower-limit value B with a prescribed number and over set in advance, which relates to the number of the repetition of the re-ignition operation. Or else, in case the number of the repetition of the re-ignition operation is the predetermined number and over, an increasing value of the proportional-valve current at each time of the repetition of the re-ignition operation, in which a reduction amount of the excess air ratio is gradually increased in each time of the repetition for reducing the excess air ratio to the first lower-limit A or the second lower-limit B is set in the controller 8. Then, the controller 8 increases the proportional-valve current each time the re-ignition operation is performed at the predetermined time interval.

Further, the controller 8 discriminates whether the excess air ratio of the mixture gas at the present moment is higher than the first lower-limit value A or the second lower-limit value B. In other words, the controller 8 discriminates whether the proportional-valve current value at the present moment is smaller than the proportional-valve current value corresponding to the first lower-limit value A or corresponding to the second lower-limit value B (STEP 14). In case the excess air ratio of the mixture gas at the present moment is higher than the first lower-limit value A or the second lower-limit value B, the controller 8 decides an increasing amount of the proportional-valve current so that the gas volume of the fuel gas in causing the igniter 32 to perform the re-ignition operation increases (STEP 15). On the other hand, in case the excess air ratio of the mixture gas at the present moment is the first lower-limit value A or the second lower-limit value B and under, the controller 8 maintains the excess air ratio of the mixture gas by causing the proportional-valve current at the present moment to continue. Thus, even though there should occur a situation in which the excess air ratio of the mixture gas at the present moment is under the first lower-limit value A or the second lower-limit value B, problems such as explosive ignition, poor combustion causing generation of carbon monoxide gas, and the like can be suppressed. Subsequently, the controller 8 memorizes and renews the proportional-valve current value, based on the discrimination in STEP 14, corresponding to the gas volume of the fuel gas (STEP 16), and let the counter count the number of repetitions of the re-ignition operations, and memorize and renew the above-mentioned number (STEP 17). Thereafter, the procedure returns to STEP 3 and the fan 5 is driven to thereby perform the pre-purging. Thereafter, the main valve 71, the proportional valve 72 and the first capacity change-over valve 73*a* are opened. The proportional valve 12 is energized at a proportional-valve current value that was memorized and renewed in STEP 16, thereby reducing the excess air ratio of the mixture gas. Then, the controller 8 causes the igniter 32 perform the re-ignition operation (STEP 4) and discriminate the presence or absence of ignition at the first portion $\mathbf{3}_1$ of the burner 3 (STEP 5). Provided that the re-ignition operation still fails to ignite the first portion 31 of the burners 3, the controller 8 repeatedly performs the operations in STEP 10 to STEP 17, and STEP 3 to STEP 5. In this case, the proportional-valve current value to be memorized in STEP 16 and the number of repetitions of re-ignition operations to be memorized in STEP 17 are successively renewed in the re-ignition operations.

In case the ignition has taken place at the burner 3 as a result of the above-mentioned the re-ignition operations, as described above, the controller 8 memorizes and renewals of the accumulated combustion time Ta (STEP 6). Subsequently, the memorized proportional-valve current value is erased (STEP 7), the current value corresponding to the gas volume of the fuel gas that was increased in the re-ignition operation immediately before reaching the ignition in the re-ignition operation. On the other hand, in case the first portion 31 of the burner 3 fails to reach ignition despite the repetitions of the re-ignition operations for a predetermined number of times, the controller 8 judges an ignition error cancels the instruction of the combustion and warns the ignition error (STEP 18). At this time, the first change-over valve 73*a*, the proportional valve 72 and the main valve 71 are closed and the fan 5 is stopped. Further, the timer is started to measure the elapsed time Te from judgment of the ignition error (STEP 19). The measured elapsed time Te is memorized in the controller 8 and is renewed sequentially. Thereafter, the controller 8 discriminates whether the warning of the ignition error has been cancelled or not (STEP 20). If cancelled, the procedure goes to STEP 9 and the repeated number of re-ignition operations is erased. The cancelling of warning of the ignition error can be done either by the remote controller or by closing the hot water supply tap.

When the combustion is again instructed after cancellation of the warning of the ignition error, the controller 8 stops the timer in STEP 1 as described above, and discriminates again whether the elapsed time Ta is within the predetermined elapsed time or not. If the elapsed time Te is within the predetermined elapsed time, the re-instruction of the combustion is estimated to be the one issued in continuation to the last combustion instruction. Therefore, the controller 8 reads the memorized proportional-valve current value (STEP 2) that corresponds to the gas volume of the fuel gas after having increased in the re-ignition operation performed immediately before the judgment of the ignition error. At this time, the timer is reset. On the other hand, in case the elapsed time Te exceeds the predetermined time, the proportional-valve current value is erased (STEP 21) and, at the same time, the timer is reset so that the controller 8 performs the same control as the one when the combustion was first instructed. In other words, when the combustion is instructed again in a state in which the elapsed time Te exceeds the predetermined time, the re-instruction of the combustion will be estimated to be a new instruction of the combustion not relating to the last instruction of combustion. Therefore, the excess air ratio of the mixture gas in the ignition operation of the igniter 32 becomes again an initial value.

Figure 2:
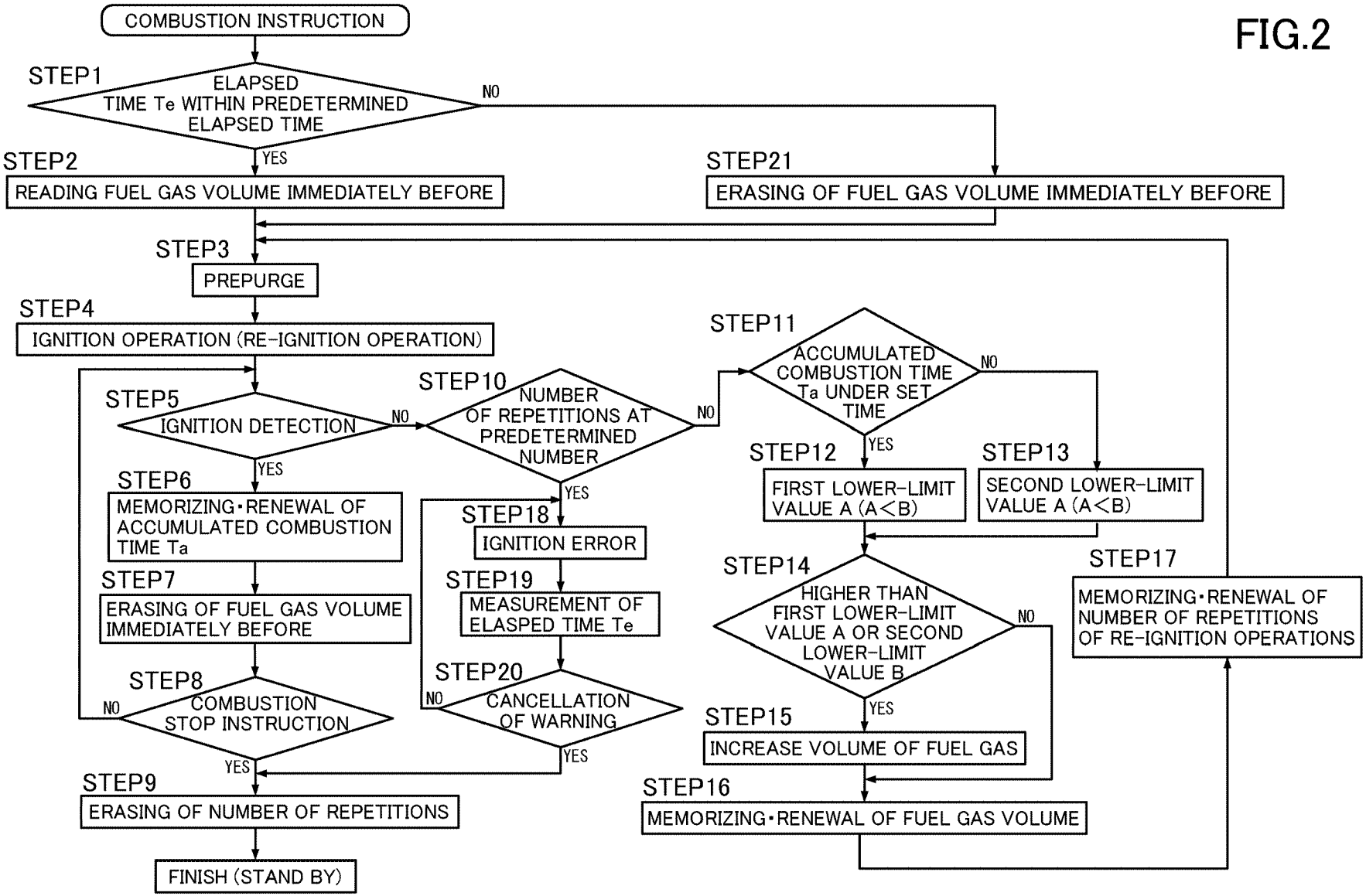
FIG. 2 is a flow chart showing a first embodiment of control which a controller of the heat-source apparatus for hot water supply as shown in FIG. 1 performs.
Figure 3:
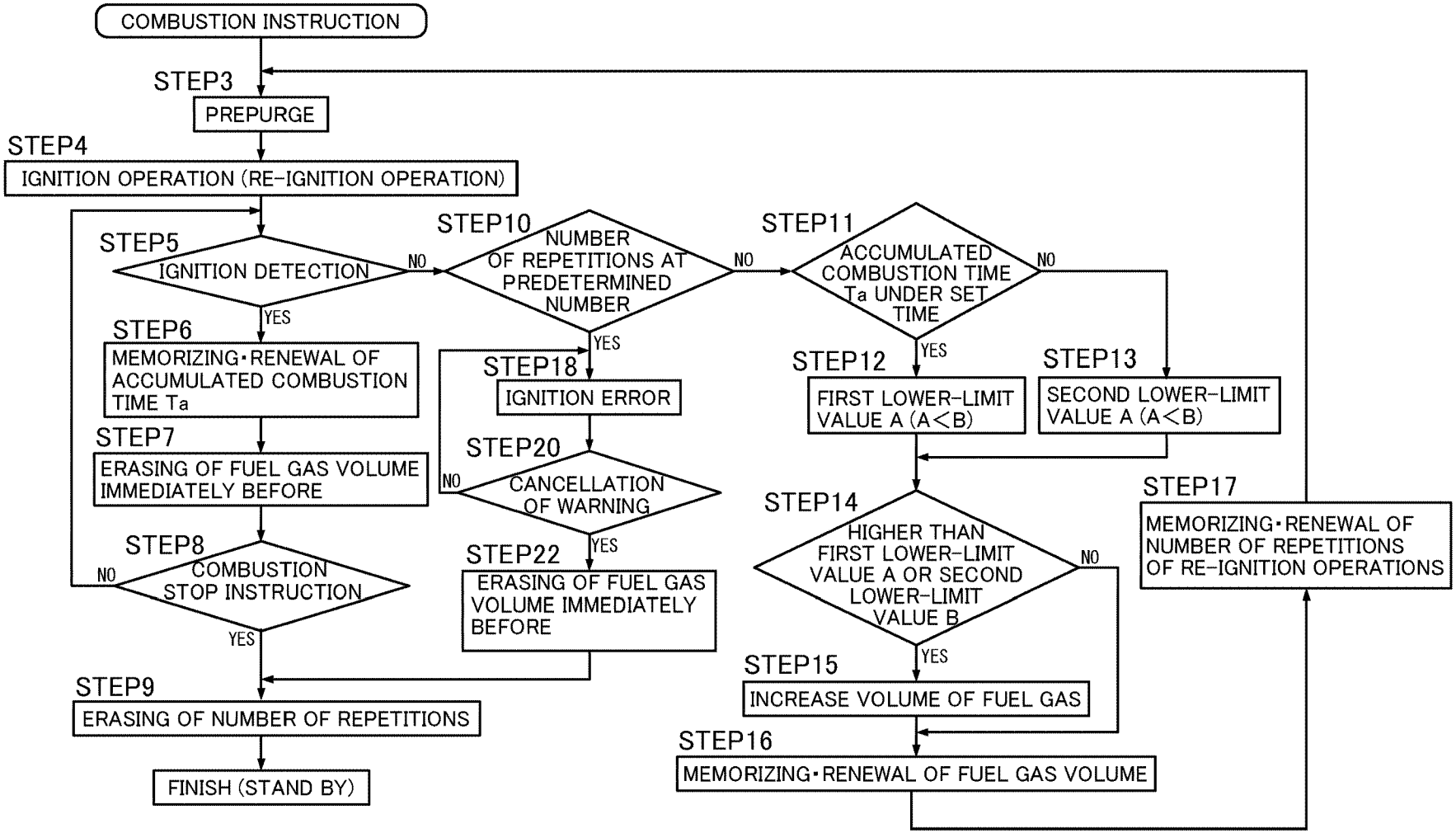
FIG. 3 is a flow chart showing a second embodiment of control which the controller arranged in the combustion apparatus of this invention.

With reference to FIG. 3, a description will now be made of a second embodiment of the control performed by the controller 8 which is disposed in the combustion apparatus 1 of this invention. The control of the controller 8 as shown in FIG. 3 is different from the control as shown in FIG. 2 in the following two points. In other words, the following steps shown in FIG. 2, i.e., STEP 1, STEP 2, STEP 19 and STEP 21, have been omitted. In addition, between the STEP 20 and STEP 9, STEP 22 for erasing the memorized proportional-valve current value that corresponds to the increased gas volume of the fuel gas in the re-ignition operation of the igniter 32, which is performed immediately before the judgment of the ignition error. In other words, the STEP 21 shown in FIG. 2 is performed after the discrimination of the presence or absence of the instruction for cancelling the warning (STEP 20). This kind of control, as shown in FIG. 3, performed by the controller 8 is generally applicable to a combustion apparatus 1, e.g., the such one provided with a heat source for heating a room, for example, and the like as the number of repetitions of the re-ignition operations required by the ignition of the first portion $\mathbf{3}_1$ of the burner 3 is larger than that of the heat-source apparatus 1*a* for hot water supply as shown in FIG. 1.

The controller 8 of the combustion apparatus 1, inclusive of the heat-source apparatus 1*a* for hot water supply as shown in FIG. 1, can be provided with an accumulated combustion time eraser 81 for erasing the accumulated combustion time Ta that has been memorized in STEP 6 shown in FIGS. 2 and 3. The accumulated combustion time eraser 81 can alternatively be disposed in the remote controller in case the remote controller is connected to the controller 8.

In the combustion apparatus 1 as above-mentioned, in case the accumulated combustion time Ta is under the predetermined set time, the mixture gas actually higher in excess air ratio than the initial value is supplied to the first portion 31 of the burner 3 due to the presence of air remaining inside the gas supply passage 7, and the first portion 31 of the burner 3 is estimated not to ignite, the controller 8 stepwise reduces the excess air ratio of the mixture gas based on the first lower-limit value from the initial value A. Then, the re-ignition operation of the igniter 32 is repeated. Similar to the conventional one, it becomes easier to succeed in the ignition at the first portion $\mathbf{3}_1$ of the burner 3. In addition, in case the accumulated combustion time Ta is the predetermined set time and over and the inside of the gas supply passage 7 is estimated to have been replaced by the mixture gas, the controller 8 stepwise reduces the excess air ratio of the mixture gas, based on the second lower-limit value B from the initial value, thereby causing the re-ignition operation of the igniter 32 to repeatedly operate. Therefore, the excess air ratio of the mixture gas can be prevented from unnecessarily reducing. In the re-ignition operation of the igniter 32, problems such as explosive ignition, poor combustion causing generation of carbon monoxide gas and the like in the re-ignition operation of the igniter 32 can be suppressed.

In addition, the controller 8 performs the stepwise reduction of the excess air ratio of the mixture gas from the initial value in the re-ignition operation of the igniter 32, by stepwise increasing the gas volume of the fuel gas supplied to the first portion 31 of the burner 3. Here, it is to be pointed out that the stepwise reduction of the excess air ratio of the mixture gas from the initial value in the re-ignition operation of the igniter 32 can also be performed by stepwise decreasing of the volume of air of the combustion air supplied to the first portion 31 of the burner 3. As to concrete manners for increasing the gas volume of the fuel gas or deceasing the air volume of the combustion air, the following five patterns can be estimated, although there will be a possibility to bring about relatively easiness or difficulty in the control of the controller 8.

Pattern 1: While keeping the air volume of the combustion air constant at a predetermined volume, the gas volume of the fuel gas is increased.

Pattern 2: The gas volume of the fuel gas is increased together with increase of the air volume of the combustion air, as a result, the excess air ratio of the mixture gas is reduced.

Pattern 3: The gas volume of the fuel gas is increased together with decrease of the air volume of the combustion air.

Pattern 4: While keeping the gas volume of the fuel gas constant at a predetermined volume, the air volume of the combustion air is decreased.

Pattern 5: The air volume of the combustion air is reduced together with reduction of the gas volume of the fuel gas, as a result, the excess air ratio of the mixture gas is decreased.

In the re-ignition operation of the igniter 32, the stepwise reduction of the excess air ratio from the initial value, which is accompanied by the of the stepwise increase of the gas volume of the fuel gas supplied to the first part $\mathbf{3}_1$ of the burner 3, corresponds to the pattern 1, pattern 2 and pattern 3. By doing so, as compared with the above-mentioned patters 4 and 5, the gas volume of the fuel gas to pass through the inside of the gas supply passage 7 toward the first portion 31 of the burners 3 increases. Therefore, the air remaining inside the gas supply passage 7 can be replaced by the fuel gas more quickly. As a consequence, the ignition at the first portion 31 of the burner 3 can be earlily accomplished. In addition, provided that the excess of air ratio is reduced by increasing the proportional-valve current so that the gas volume of the fuel gas is stepwise increased while keeping constant at the predetermined rotational speed or increasing the air volume of the combustion air to be supplied to the first portion 31 of the burner 3 as in the above-mentioned embodiment (the above-mentioned patterns 1 and 2), the air volume of the combustion air need not be reduced. Therefore, the wind-resistance characteristics of the combustion apparatus 1 can be maintained well.

Further, in case the such elapsed time Te from the judgment of the ignition error or from the cancellation of warning of the ignition error to the re-instruction of the ignition is within the predetermined elapsed time, the first instruction of the combustion and the re-instruction of the combustion are estimated to be instructions made in succession. Therefore, the excess air ratio of the mixture gas at the time of the re-instruction of the combustion can be reduced to the one which is lower than the initial value of the excess air ratio of the mixture gas at the time of the initial instruction. Such being the case, the stepwise reduction of the excess air ratio of the mixture gas toward the first lower-limit value A or toward the second lower-limit value B can be accelerated, whereby the ignition at the first portion 31 of the burner 3 can be more easily accomplished. Furthermore, in case the excess air ratio of the mixture gas at the time of the re-instruction of the combustion is reduced to the one which is lower than that of the mixture gas, which has been memorized at the time of the re-ignition operation of the igniter 32, immediately before the judgment of the ignition error, the reduction of the excess air ratio of the mixture gas can be more promoted. It is thus more advantageous due to the ignition at the first portion 31 of the burner 3. For example, depending on the such predetermined number of times as set the number of repetitions of the re-ignition operations of the igniter 32, the number of repetitions of the re-ignition of the igniter 32 will not reach the first lower-limit value A or the second lower-limit value B but reaches the predetermined number of the repetitions of the re-ignition operations of the igniter 32. There will thus be a case in which the controller will make a discrimination of the ignition error. In such a case, the adjustment of the excess air ratio of the mixture gas in the re-instruction of the combustion will be advantageous to an early ignition of the first portion 31 of the burner 3. On the other hand, in case the elapsed time Te from the judgment of the ignition error or from the cancelation of the warning of the ignition error to the re-instruction of the combustion exceeds the predetermined elapsed time, the initial instruction and the re-instruction of the combustion are regarded as discontinuous separate ones. Therefore, the excess air ratio of the mixture gas in the re-instruction of the combustion can be returned to the initial value, so that the ignition operation can newly be performed. The safety of ignition operation can thus be secured well.

Then, after a lapse of a predetermined accumulated combustion time Ta from the installation of the combustion apparatus 1, accompanied by re-filling of a gas tank, renewal of the gas supply passages 7, and the like, in case the excess air ratio of the mixture gas actually supplied to the first portion 31 of the burner 3 exceeds the initial value due to the air again remaining inside the gas supply passages 7, the accumulated combustion time Ta memorized by the controller 8 can be erased by the accumulated combustion time eraser 81. Therefore, the lower-limit value of the excess air ratio of the mixture gas to be stepwise reduced from the initial value in the re-ignition operation of the igniter 32 is renewed from the second lower-limit value B once again to the first lower-limit value A. Accordingly, as is a same case of a new installation of the combustion apparatus 1, and the like, the ignition at the first portion $\mathbf{3}_1$ of the burner 3 may be more easily accomplished.

Descriptions have so far been made of the embodiments of this invention, but this invention will not be limited to the above. For example, various embodiments are possible of the arrangement of the burners 3 and the accompanying arrangement of the gas supply passages 7. In addition, in case a variable orifice in which an orifice diameter can be changed is disposed inside the gas supply passage 7 in order to adjust the gas volume of the fuel gas, the variable orifice is controlled by the controller 8. While the rotational speed of the fan 5 is kept constant at the predetermined rotational speed, the orifice diameter of the variable orifice is stepwise enlarged to thereby increase the gas volume of the fuel gas so that the excess air ratio of the mixture gas can be stepwise reduced. In this case, the controller 8 has set in orifice diameters corresponding to the first lower-limit value A and the second lower-limit value B, respectively. The controller 8 memorizes and renews the variable orifice diameters corresponding to the increased gas volume of the fuel gas.

Further, the stepwise reduction of the excess air ratio of the mixture gas from the initial value can also be performed, as described above, by stepwise decreasing the air volume of the combustion air supplied to the first portion 31 of the burner 3. In this case, the reduction of the air volume of the combustion air is accomplished, while keeping constant at a predetermined volume the gas volume of the fuel gas supplied to the burners 3, by decreasing the rotational speed of the fan 5 (above-mentioned pattern 4). In this manner, in case the excess air ratio of the mixture gas is reduced by decreasing the air volume of the combustion air, the controller 8 will have set in the rotational speeds of the fan 5 respectively corresponding to the first lower-limit value A and the second lower-limit value B. The controller 8 memorizes and renews the decreased rotational speed of the fan 5 corresponding to the reduced air volume of the combustion air.

In other words, as manners of stepwise reducing the excess air ratio of the mixture gas to be supplied to the first portion 31 of the burner 3, as long as the excess air ratio of the mixture gas supplied to the first portion 31 of the burner 3 is reduced, an appropriate one may be selected out of the five patterns of the above-mentioned pattern 1 to pattern 5.

Furthermore, in the control performed by the controller 8 as shown in FIG. 2, STEP 19 may otherwise be inserted not between STEP 18 and STEP 20, but between STEP 20 and STEP 9. In this case, the timer can be started when the warning of the ignition error is cancelled, and the elapsed time Te memorized by the controller 8 can be the elapsed time from the cancellation of the warning of the ignition error to the re-instructing of the combustion. By the way, the predetermined elapsed time that is set as the basis for discrimination in STEP 1 will be changed to the one relating to the elapsed time from the cancelation of warning of the ignition error to the re-instruction of the combustion.

Then, at the time of judging the ignition error or after the warning of the ignition error is cancelled, in case the combustion is re-instructed at the predetermined elapsed time, the excess air ratio of the mixture gas in the ignition operation of the igniter 32 can be not only the excess air ratio memorized by the controller 8 in the such re-ignition operation of the igniter 32 as was performed immediately before the judgment of the ignition error, but also the values under the memorized excess air ratio. As the excess air ratio of the mixture gas in this case, there can be exemplified a value that is a lower one than the memorized excess of air ratio by the controller 8 and will not reach the first and second lower-limits A and B at such as the second ignition operation from beginning the control.

EXPLANATION OF MARKS

1 combustion apparatus
2*a* combustion chamber
3 burner
32 igniter
33 flame rod (ignition detector)
5 fan
7 gas supply passage
72 proportional valve
8 controller
81 eraser for accumulated combustion time
Ta accumulated combustion time
A first lower-limit value
B second lower-limit value
Te elapsed time from judgment of ignition error or from cancellation of warning of ignition error to re-instruction of combustion

The invention claimed is:

1. A combustion apparatus comprising: a burner disposed in a combustion chamber and for combusting a mixture gas of combustion air and a fuel gas; a fan for supplying the burner with combustion air; a gas supply passage for supplying the burner with the fuel gas; a proportional valve installed in the gas supply passage; an igniter for igniting the burner; an ignition detector for detecting ignition at the burner; and a controller for controlling the fan, the proportional valve, and the igniter, respectively;

the controller having set in advance an initial value of such an excess air ratio of the mixture gas as is suitable for the ignition at the burner;

the controller adjusting an air volume of the combustion air and a gas volume of the fuel gas for making the excess air ratio of the mixture gas an initial value upon receipt of instruction of combustion at the burner, stepwise reducing the excess air ratio of the mixture gas from the initial value in case the burner fails to ignite despite an ignition operation of the igniter, and causing the igniter to repeatedly perform a re-ignition operation, wherein the controller memorizes an accumulated combustion time by accumulating combustion time of the burner, and wherein the controller is set as a lower-limit value of the excess air ratio of the mixture gas for reducing from the initial value in the re-ignition operation of the igniter, a first lower-limit value in case the accumulated combustion time is under a predetermined set time, and a second lower-limit value which is higher than the first lower-limit value in case the accumulated combustion time is the predetermined set time and over.

2. The combustion apparatus according to claim 1, wherein the controller performs the stepwise reduction of the excess air ratio of the mixture gas from the initial value in the re-ignition operation of the igniter by stepwise increasing the gas volume of the fuel gas supplied to the burner.

3. The combustion apparatus according to claim 1, wherein the controller counts the number of repetitions of the re-ignition operations of the igniter, judges that an ignition error has occurred in case the ignition at the burner fails to take place even after the number of repetitions has reached the predetermined number of repetitions, cancels the instruction of the combustion, and warns an ignition error, wherein the controller memorizes the excess air ratio of the mixture gas in the such re-ignition operation of the igniter as was performed immediately before the judgment of the ignition error, and wherein the controller adjusts the excess air ratio of the mixture gas in the ignition operation of the igniter to not more than the memorized excess air ratio after the judgment of the ignition error, cancellation of the instruction of the combustion and warning of the ignition error, when the warning of the ignition error has been cancelled and the combustion is once again re-instructed, in case elapsed time from the judgment of ignition error or from the cancellation of the warning of the ignition error to the re-instruction of combustion is within a predetermined elapsed time.

4. The combustion apparatus according to claim 1, wherein the controller further comprises an accumulated combustion time eraser for erasing the accumulated combustion time that the controller has memorized.

* * * * *